US007249968B1

(12) United States Patent
Fish et al.

(10) Patent No.: US 7,249,968 B1
(45) Date of Patent: Jul. 31, 2007

(54) ELECTRICAL CONNECTIONS FOR HARSH CONDITIONS

(75) Inventors: Douglas J. Fish, Middletown, CT (US); Carl Allison Perry, Middletown, CT (US); William Evans Turner, Durham, CT (US); Mark Ellsworth Wassell, Kingwood, TX (US)

(73) Assignee: APS Technology, Inc.

( * ) Notice: Subject to any disclaimer, the term of this patent is extended or adjusted under 35 U.S.C. 154(b) by 0 days.

(21) Appl. No.: 10/919,633

(22) Filed: Aug. 16, 2004

(51) Int. Cl.
*H01R 9/05* (2006.01)

(52) U.S. Cl. ..... 439/578

(58) Field of Classification Search ..... 439/578, 439/452, 585, 581, 620
See application file for complete search history.

(56) References Cited

U.S. PATENT DOCUMENTS

| | | | | |
|---|---|---|---|---|
| 3,753,193 | A * | 8/1973 | Teagno et al. | 439/854 |
| 4,482,296 | A | 11/1984 | Wassell et al. | 416/215 |
| 4,482,297 | A | 11/1984 | Mosimann et al. | 416/218 |
| 4,684,326 | A | 8/1987 | Wassell et al. | 416/215 |
| 4,779,352 | A | 10/1988 | Lang | 33/834 |
| 5,126,564 | A | 6/1992 | Perry et al. | 250/254 |
| 5,134,285 | A | 7/1992 | Perry et al. | 250/269.3 |
| 5,134,783 | A | 8/1992 | Perry | 33/645 |
| 5,135,059 | A | 8/1992 | Turner et al. | 175/101 |
| 5,144,126 | A | 9/1992 | Perry et al. | 250/254 |
| 5,216,242 | A | 6/1993 | Perry et al. | 250/269.1 |
| 5,226,332 | A | 7/1993 | Wassell | 73/152.58 |
| 5,251,708 | A | 10/1993 | Perry et al. | 175/41 |

(Continued)

OTHER PUBLICATIONS

Nguyen, T., General Procedure For Boot Kit Assembly & Installation Guide for Seal-Connect®, Green, Tweed & Co., Jun. 26, 2002, 5 pages.

*Primary Examiner*—J. F. Duverne
(74) *Attorney, Agent, or Firm*—Woodcock Washburn LLP

(57) ABSTRACT

Apparatuses are provided which basically comprise a socket which has at least two contiguous passages formed therein which are adapted to receive exposed wire and/or insulated wire. Bonding materials and crimp joints, alone or in combination, are provided to further secure the assemblies. In one embodiment, electrical connection assemblies are provided, which comprise an electrically conductive wire encapsulated by a sheath of insulating material, the insulating sheath having a first end, a first portion of the wire extending beyond the first end of the insulated sheath; and a socket having first and second contiguous passages formed therein, the first passage being of larger diameter than the second passage, the first portion of the wire being disposed in the second passage, the first end of the insulating sheath being disposed in the first passage. In other embodiments, the assemblies further comprise electrically conductive bonding material disposed in the first and second passages. Electrically conductive bonding material can bond the first portion of the wire to the second passage the first end of the insulating sheath to the second passage. Yet other embodiments have at least one crimp joint formed between the socket and either the exposed wire or the insulated wire. For example, a crimp joint can be formed between the first passage and first end of the insulating sheath. Another desirable crimp joint can be formed, alone or in combination with the crimp joint associated with the insulated sheath, between the second passage and the first portion of the wire. Further, in conjunction with one or more crimp joints, conductive bonding materials can also be used with the assemblies as described above. Methods of electrical communications utilizing such devices are also provided.

7 Claims, 3 Drawing Sheets

U.S. PATENT DOCUMENTS 6,102,681 A 8/2000 Turner ..... 418/48
6,105,690 A 8/2000 Biglin, Jr. et al. ..... 175/48
6,123,561 A 9/2000 Turner et al. ..... 439/194
6,134,892 A 10/2000 Turner et al. ..... 62/3.2
6,257,356 B1 7/2001 Wassell ..... 175/61
6,285,014 B1 9/2001 Beck et al. ..... 219/644
6,491,546 B1 * 12/2002 Perry ..... 439/620
6,507,401 B1 1/2003 Turner et al. ..... 356/436
6,547,016 B2 4/2003 Wassell ..... 175/45
6,622,803 B2 9/2003 Harvey et al. ..... 175/325.3
6,634,427 B1 10/2003 Turner et al. ..... 166/298
6,707,556 B2 3/2004 Turner et al. ..... 356/436
6,714,138 B1 3/2004 Turner et al. ..... 340/854.3
2002/0011358 A1 1/2002 Wassell ..... 175/73
2005/0142937 A1 * 6/2005 Lin ..... 439/578
2005/0181667 A1 * 8/2005 Kao ..... 439/578
2005/0181669 A1 * 8/2005 Holland ..... 439/578
2005/0221669 A1 * 10/2005 Kodaira ..... 439/578

* cited by examiner

ELECTRICAL CONNECTIONS FOR HARSH CONDITIONS

FIELD OF THE INVENTION

The present invention relates to electrical connections, and more particularly to electrical connections suitable for withstanding harsh conditions.

BACKGROUND OF THE INVENTION

Electrical connections that can withstand harsh conditions, for example high pressures and exposure to high flow, are utilized in various applications. For example, in drilling applications, such as gas, oil or geothermal drilling, down hole environments can be exposed to pressures of 1,000 to 20,000 psi and flows containing muddy and/or rocky materials. It is often desirable to employ electronic sensing equipment in down hole environments to provide information about the conditions to a drill operator. Reliable electrical connections are important to ensure that information is reliably transmitted.

Some methods have been developed to create connections between an insulated wire and a socket, suitable for harsh applications, but the methods require, for example, creating a solder joint or crimping the socket to an exposed portion of the wire to make the electrical connection. These types of connection methods create assemblies that contain wire disposed between very rigid areas, such as insulation and the socket. A wire so disposed can be susceptible to failure from bending or tensile loads.

Hence, there exists a need to provide electrical connections which exhibit excellent strength characteristics. There also exists a need to create assemblies of a wire and a socket that are strong enough to absorb bending forces while ensuring excellent electrical conductivity. Finally, there is an on-going demand for providing electrical connections which remain functional for long periods of time under harsh conditions.

SUMMARY OF THE INVENTION

These needs and others are met by the methods and apparatuses of the present invention. The apparatuses basically comprise a socket which has at least two contiguous passages formed therein which are adapted to receive exposed wire and/or insulated wire such that forces exerted on the exposed wire are minimized. As such, it is an objective of the present invention to substantially disperse bending and tensile forces to areas of the electrical assemblies such as the wire insulation, bonding materials, and crimp joints. In one embodiment, electrical connection assemblies are provided, which comprise an electrically conductive wire encapsulated by a sheath of insulating material, the insulating sheath having a first end, a first portion of the wire extending beyond the first end of the insulated sheath; and a socket having first and second contiguous passages formed therein, the first passage being of larger diameter than the second passage, the first portion of the wire being disposed in the second passage, the first end of the insulating sheath being disposed in the first passage. In other embodiments, the assemblies further comprise electrically conductive bonding material disposed in the first and second passages. The electrically conductive bonding material bonds the first portion of the wire to the second passage the first end of the insulating sheath to the second passage.

Yet other embodiments have at least one crimp joint formed between the socket and either the exposed wire or the insulated wire. For example, a crimp joint can be formed between the first passage and first end of the insulating sheath. Another desirable crimp joint can be formed, alone or in combination with the crimp joint associated with the insulated sheath, between the second passage and the first portion of the wire. Further, in conjunction with one or more crimp joints, conductive bonding materials can also be used with the assemblies as described above.

For applications where the assemblies are exposed to, for example, mud and moisture, the assemblies can further comprise a boot surrounding the socket and a portion of the insulated sheath. In conjunction with the boot, it is optional to provide a coating of grease on an outer wall of the socket to facilitate overlaying the boot around the socket and portion of insulated wire.

In harsh environments, such as down holes of oil drilling applications, electrical assemblies in accordance with the present invention can include the wire being located in a subsurface environment and the socket being connected to a processor, wherein the processor is at substantially atmospheric conditions. In some cases, the wire is an antenna. The processor, thus, can process signals from the wire and send information about the down hole conditions to an operator at the surface.

Kits are also provided by the present invention which comprise an electrical socket having first and second contiguous passages formed therein, the first passage being of a larger diameter than the second passage, an electrically conductive bonding material, and instructions for creating an electrical connection with an insulated wire. In some instances, the kits can further comprise a boot.

Methods of making electrical connections are provided which comprise providing an electrically conductive wire encapsulated by a sheath of insulating material, wherein the insulating sheath has a first end and a first portion of the wire extends beyond said first end of said insulated sheath; providing a socket having first and second contiguous passages where the first passage has a larger diameter than the second passage; and inserting the first portion of the wire into the second passage and inserting the first end of the insulated sheath into the first passage.

The methods can further comprise inserting an electrically conductive bonding material into the first and second passages, wherein the electrically conductive bonding material bonds the first portion of the wire to the second passage and the first end of the insulating sheath to the second passage.

Other methods further comprise crimping the socket in the vicinity of the first passage so as to form a crimp joint between the first passage and first end of the insulating sheath. Also, it may be desirable, either alone or in combination with crimping the area of the first passage and insulated wire, to crimp the socket in the vicinity of the second passage so as to form a crimp joint between the second passage and the first portion of the wire. Further, methods can include inserting an electrically conductive bonding material into the socket passages in conjunction with one or more crimp joints.

In some embodiments, the method the steps of forming the crimp joint between the first passage and the first end of the insulating sheath are performed at a first gauge setting and the step of forming the crimp joint between the second passage and the first portion of the wire is performed at a second gauge setting which is set for a smaller diameter wire than the first gauge setting.

With respect to the sockets, in some instances sockets come in standard configurations which have a single passage, typically adapted to contain an exposed wire, formed therein. As such, methods in accordance with the present invention can further comprise counterboring the sockets to create an additional passage which is adapted to receive an insulated wire.

Yet other methods include inserting the socket and a portion of the insulated sheath into a boot. In addition, methods can further comprise coating an outer wall of the socket with grease.

In harsh environments, such as down holes of oil drilling applications, methods in accordance with the present invention can include transmitting information from a subsurface environment to a processor which is at substantially atmospheric conditions via an electrical connection.

BRIEF DESCRIPTION OF THE DRAWINGS

The present invention will be better understood, and its objectives and advantages will become apparent to those skilled in the art by reference to the following detailed description when taken in conjunction with the following drawings, in which.

DETAILED DESCRIPTION

Figure 1:
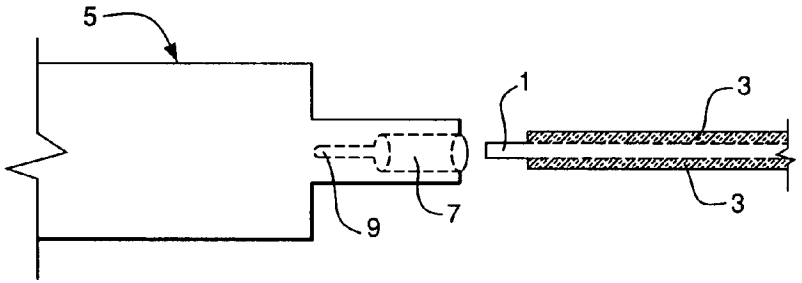
FIG. 1 is a diagram, partially schematic, of a socket and an insulated wire in accordance with the present invention.

Referring to the drawings wherein the same reference numerals in different figures refer to like elements, FIG. 1 is a schematic of components of an electrical connection assembly, displaced from each other for sake of clarity. An electrically conductive wire 1 is encapsulated by a sheath of insulation 3 surrounding the wire. In some embodiments, a PEEK (polyetheretherketone) insulated wire is preferred because it is known to be very tough and high pressure capable, making it a good candidate for withstanding bending, tensions, and high pressure environments. An end of the wire and a portion of the insulated wire will be located within a socket 5, also made of electrically conductive material, which has at least two passages that are continuous with each other. A first passage 7 can be sized to hold a portion of insulated wire and a second passage 9 can be sized to hold wire. In a preferred embodiment, the first passage is 0.080" long. The passages 7 and 9 are typically of different diameters. Preferably, but not intending to be limiting, the diameter of the first passage 7 is larger than the diameter of the second passage 9. In certain embodiments, more than two passages may be desirable, the diameters of the passages being adapted to fit wire or other electrically conductive material, in combination with or independent of insulating material and/or bonding material. By fitting a portion of insulated wire within the socket, the strength of the insulation can be used to withstand the stresses placed at the juncture of the insulated wire and the socket.

According to the current invention, the electrical connection is made by stripping a portion of the insulation 3 so as to expose the end of the conductive wire 1. The portion of the exposed wire 1 is inserted into the passage 9 and the adjacent portion of the insulation 3 is inserted into the larger passage 7.

Figure 2:
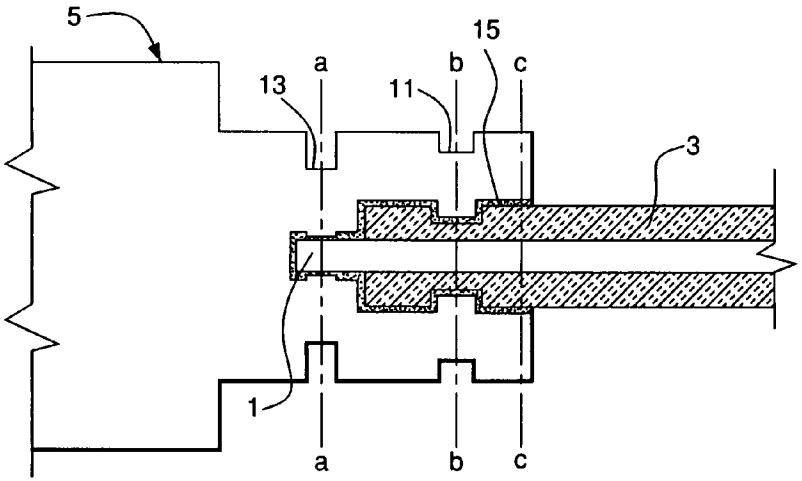
FIG. 2 is a schematic diagram of an insulated wire inserted into a socket in accordance with the present invention.
Figure 4C:
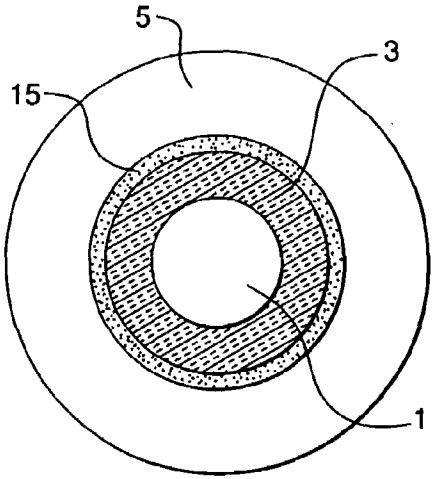
FIG. 4C shows a transverse cross-section view taken through line c—c as depicted in FIG. 2
Figure 4B:
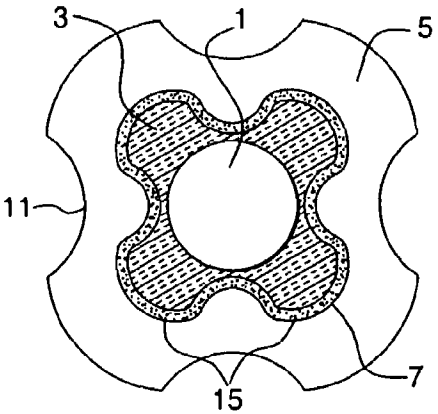
FIG. 4B shows a transverse cross-section view taken through line b—b as depicted in FIG. 2.
Figure 4A:
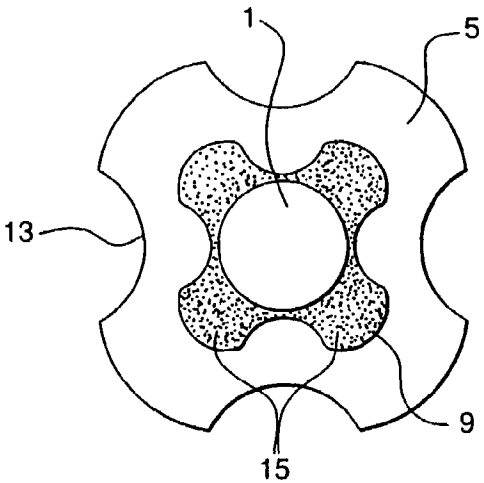
FIG. 4A shows a transverse cross-section view taken through line a—a as depicted in FIG. 2.

With reference to FIGS. 2 and 4, in some embodiments, it is desirable to crimp the socket in the vicinity of the first passage 7 to create a first crimp joint 11 to substantially secure an end of the insulation sheath. For crimping the socket in the vicinity of the first passage 7 a setting for 14 gauge wire is preferred. In other embodiments, either alone or in conjunction with the first crimp joint 11, it may be desirable to crimp another area of the socket in the vicinity of the second passage 9 to create a second crimp joint 13 to substantially secure the exposed wire and create electrical contact. A crimp that is set for 16 gauge wire is preferred for the vicinity of the second passage. The crimped areas 11 and 13 create a mechanical lock between the socket and wire. It is helpful to avoid overcrimping the areas to avoid weakening the insulation or exposed wire. A very strong electromechanical connection is created by a double crimp which creates an assembly that can withstand harsh conditions, such as high pressure, large bending, and tensile loads.

An electrically conductive bonding material 15, for example, electrically conductive epoxy LOCITE® 3880 (Supplied by Locite Corp., Hartford, Conn.), can be inserted into the socket and come in substantial contact with the exposed wire and the portion of insulated wire that is located in the socket. The bonding material provides electrical contact while providing a bond between the wire and the socket and between the insulated portion and the socket, which provides added strength to the connection assembly. Although not depicted in the figures, it is conventional to have a weep hole that passes through the socket wall to the passage area of the socket. Upon crimping, epoxy typically oozes out of the weep hole and around the insulated wire.

Figure 3:
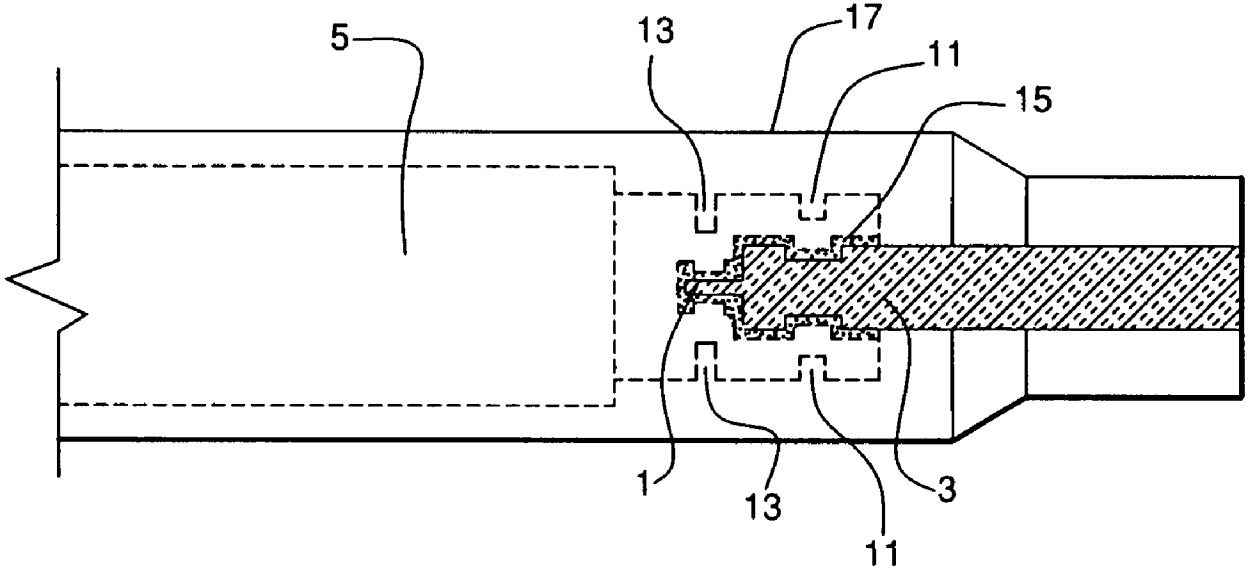
FIG. 3 is a schematic diagram of a boot overlaying a socket and wire assembly in accordance with the present invention.

With reference to FIG. 3, as is conventional, a boot 17 can be placed to cover both the insulated wire adjacent the socket and the socket itself. The boot serves to protect the area where the insulated wire enters the socket from things that can interfere with the integrity of the electrical connection, for example, moisture and debris that are present in the down hole.

In some circumstances, such as when the electrical connection is part of the antenna of a downhole assembly in a drill string, it is desirable to place a support under the boot and adjacent insulated wire and to encapsulate the assembly in RTV. A metal cover plate is secured around the assembly.

The present invention may be embodied in other specific forms without departing from the spirit or essential attributes thereof an, accordingly, reference should be made to the appended claims, rather the foregoing specification, as indicating the scope of the invention.

What is claimed is:

1. An electrical connection assembly comprising:

an electrically conductive wire encapsulated by a sheath of insulating material, said insulating sheath having a first end, a first portion of said wire extending beyond said first end of said insulated sheath;

a unitary socket having first and second contiguous and axially aligned passages formed therein, said first passage being of larger diameter than said second passage, said first portion of said wire being disposed in said second passage, a first portion of said insulating sheath adjacent said first end being disposed in said first passage; and a crimp joint formed between said first passage and first portion of said insulating sheath.

2. An electrical connection assembly comprising:

an electrically conductive wire encapsulated by a sheath of insulating material, said insulating sheath having a first end, a first portion of said wire extending beyond said first end of said insulated sheath;

a unitary socket having first and second contiguous and axially aligned passages formed therein, said first passage being of larger diameter than said second passage, said first portion of said wire being disposed in said second passage, a first portion of said insulating sheath adjacent said first end being disposed in said first passage; and a crimp joint formed between said second passage and said first portion of said wire.

3. The electrical connection assembly of claim 2 further comprising a second crimp joint formed between said first passage and first portion of said insulating sheath.

4. The electrical connection assembly of claim 3 further comprising electrically conductive bonding material disposed in said first and second passages, said electrically conductive bonding material bonding said first portion of said wire to said second passage of said socket and bonding said first portion of said insulating sheath to said second passage of said socket.

5. An electrical connection assembly comprising:

an electrically conductive wire encapsulated by a sheath of insulating material, said insulating sheath having a first end, a first portion of said wire extending beyond said first end of said insulated sheath;

a socket forming an exterior surface enclosing first and second contiguous and axially aligned passages extending axially into said socket, said first passage being of larger diameter than said second passage, said first portion of said wire being disposed in said second passage, a first portion of said insulating sheath adjacent said first end being disposed in said first passage; and a first crimp joint and a second crimp joint formed in said exterior surface of said socket, wherein said first crimp joint and said second crimp joints are axially displaced along said exterior surface of said socket so that said first crimp joint is axially aligned with said first passage and said second crimp joint is axially aligned with said second passage, and wherein said socket exterior surface is permanently deformed by said first crimp joint so as to secure said insulating sheath first portion into said first passage, and wherein said socket exterior surface is permanently deformed by said second crimp joint so as to secure said first wire portion into said second passage.

6. The electrical connection assembly of claim 5, wherein said first crimp joint is formed between said first passage and first portion of said insulating sheath; and said second crimp joint is formed between said second passage and said first portion of said wire.

7. The electrical connection assembly of claim 5 further comprising electrically conductive bonding material disposed in said first and second passages, said electrically conductive bonding material bonding said first portion of said wire to said second passage of said socket and bonding said first portion of said insulating sheath to said second passage of said socket.

* * * * *

UNITED STATES PATENT AND TRADEMARK OFFICE

CERTIFICATE OF CORRECTION

PATENT NO. : 7,249,968 B1
APPLICATION NO. : 10/919633
DATED : July 31, 2007
INVENTOR(S) : Douglas J. Fish et al.

It is certified that error appears in the above-identified patent and that said Letters Patent is hereby corrected as shown below:

Cover Page, Item 56, line 5:

Delete "4,779,352" insert --4,779,852--; delete "Lang" insert --Wassell--; delete "33/834" insert --267/125--.

Signed and Sealed this
Thirteenth Day of November, 2012

David J. Kappos

David J. Kappos
*Director of the United States Patent and Trademark Office*